United States Patent [19]

Nakano

[11] Patent Number: 4,982,240

[45] Date of Patent: Jan. 1, 1991

[54] CLEANING DEVICE

[75] Inventor: Masaru Nakano, Tsukuba, Japan

[73] Assignee: Hitachi, Ltd., Tokyo, Japan

[21] Appl. No.: 508,170

[22] Filed: Apr. 12, 1990

[30] Foreign Application Priority Data

Apr. 14, 1989 [JP] Japan ..... 1-92858

[51] Int. Cl.[5] ..... G03G 21/00

[52] U.S. Cl. ..... 355/299

[58] Field of Search ..... 355/299, 296, 298, 297

[56] References Cited

U.S. PATENT DOCUMENTS

| | | | |
|---|---|---|---|
| 4,127,083 | 11/1978 | Sesoko | 355/296 X |
| 4,145,137 | 3/1979 | Sunaga et al. | 355/299 |
| 4,522,487 | 6/1985 | Misawa | 355/299 |
| 4,730,205 | 3/1988 | Ogiri et al. | 355/298 |
| 4,891,679 | 1/1990 | Saijo | 355/298 |

FOREIGN PATENT DOCUMENTS

| | | | |
|---|---|---|---|
| 0099465 | 6/1984 | Japan | 355/296 |

*Primary Examiner*—A. T. Grimley
*Assistant Examiner*—Sandra L. Hoffman
*Attorney, Agent, or Firm*—Antonelli, Terry, Stout & Kraus

[57] ABSTRACT

A cleaning device for an electrophotographic copying machine includes a blade mounted on a housing so as to scrape off a residual toner from the surface of a photosensitive member. A seal member is mounted on the housing so as to guide the scraped-off toner into the housing to collect the toner in the housing. A rotary screw discharges the collected toner from the housing. A vibrating member is mounted on the housing and disposed adjacent to and inwardly of the seal member. The vibrating member includes a plate-like portion having an edge portion contacted with the rotary screws, and is adapted to be vibrated during rotation of the rotary screw. The plate-like portion is formed with a number of slits spaced apart from each other by a distance smaller than a pitch of the rotary screw, so as to enable to effectively vibrate the plate-like portion of the vibrating member.

7 Claims, 2 Drawing Sheets

CLEANING DEVICE

BACKGROUND OF THE INVENTION

1. Field of the Invention

This invention relates generally to a cleaning device for an electrophotographic copying machine, and more particularly to a cleaning device suited for preventing an untransferred toner from depositing within the housing, thereby preventing contamination of the interior of the machine.

2. Prior Art

A conventional cleaning device disclosed in Japanese Patent Unexamined Publication No. 62-23080 comprises a seal member for collecting an untransferred toner, scraped off from a photosensitive member by a blade, in a housing, and a convey means for discharging the collected toner from the housing. Projections are formed on part of the seal member to interfere with the convey means, so that vibration can be imparted to the seal member by the convey means through the projections, thereby preventing the toner from depositing on the seal member. With such structure, the contact between the seal member and the surface of the photosensitive member becomes imperfect when the seal member is subjected to vibration, which results in a risk that the toner is scattered into the machine.

Japanese Patent Unexamined Publication No. 64-59283 discloses a cleaning device comprising a rotary screw for conveying a toner and a guide plate or a vibrating member formed, at an edge portion thereof contacted with the rotary screw, with projections spaced apart from each other. The rotary screw contacts and presses the projections to vibrate the guide plate, thereby leading the toner fallen onto the guide plate to the rotary screw. With this structure, however, the pressing force applied by the rotary screw to the projections of the guide plate for vibrating the latter is difficult to be propagated to the portions of the guide plate other than the projections, which makes it difficult to lead the toner accumulated on the latter portions of the guide plate to the rotary screw.

Thus, in the device disclosed in the Japanese Patent Unexamined Publication No. 64-59283 it is difficult to effectively vibrate the vibrating member on which the toner scraped off and falling from the photosensitive member is accumulated or deposited, and hence to trustworthily lead the toner falls onto the vibrating member to the rotary screw.

SUMMARY OF THE INVENTION

It is therefore an object of the invention to provide a cleaning device in which a toner is prevented from depositing on a seal member, and a proper contact between the seal member and the surface of a photosensitive member is trustworthily maintained, whereby the toner is prevented from being scattered into a machine.

It is another object of the invention to provide a cleaning device which is constructed to effectively vibrate a vibrating member on which a toner scraped off and falling from the photosensitive member is deposited, thereby trustworthily leading the toner fallen onto the vibrating member to a rotary screw.

According to the invention, there is provided a cleaning device for an electrophotographic copying machine having a photosensitive member comprising: a housing; a blade mounted on the housing for scraping off a residual toner from a surface of the photosensitive member; a seal member mounted on the housing for guiding the scraped-off toner into housing to collect the toner therein; convey means having a rotary screw for conveying the collected toner from the housing to the outside; and a vibrating member mounted on the housing at a location adjacent to and inwardly of the seal member and interfering with the rotary screw to be vibrated; the vibrating member including a plate-like portion, the plate-like portion having an edge portion contacted with the rotary screw and formed with a number of slits spaced apart from each other by a distance smaller than a pitch of the rotary screw.

The plate-like portion of the vibrating member is divided by the slits into a number of areas or sections, and the plate-like portion is vibrated substantially entirely as being interfered or contacted by the rotary screw. Thus, the toner fallen onto the vibrating member is positively led to the rotary screw.

DESCRIPTION OF THE PREFERRED EMBODIMENT OF THE INVENTION

One preferred embodiment of the invention will now be described with reference to the drawings.

Figure 1:
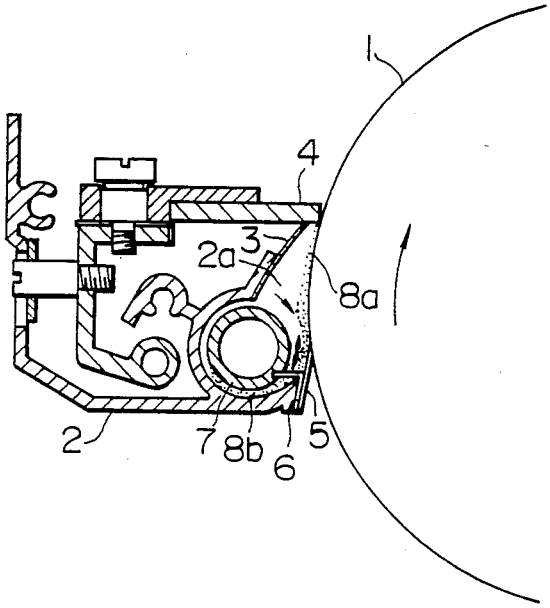
FIG. 1 is a cross-sectional view of a cleaning device according to an embodiment of the present invention.

FIG. 1 shows a cleaning device of the present invention. This cleaning device comprises a housing 2, a blade 4, a seal member 5, a vibrating member 6, a convey means including a rotary screw 7 for discharging a collected toner from the housing 2, and a cover 3 for preventing contamination of the housing by the toner. Reference numeral 1 denotes a photosensitive member of an electrophotographic copying machine.

The untransferred (residual) toner **8*a*, remaining on the surface of the photosensitive member 1 after transfer of the toner image from the photosensitive member, is scraped off from the photosensitive member 1 by the blade 4. The toner thus scraped off is guided by the seal member 5 and is collected in an opening portion 2*a* of the housing 2. The seal member 5 is mounted on the opening portion 2*a* of the housing 2 and is held in contact with the surface of the photosensitive member 1. The seal member 5 serves to prevent the thus collected toner 8*b* from leaking through a lower opening of the housing 2. The seal member 5 is disposed in an inclined condition so that the scraped-off toner 8*b* can side down on the seal member 5 to be introduced into the convey means including the rotary screw 7. The seal member 5 is fixedly mounted on the housing 2 in such a manner that the seal member 5 is always held in contact with the surface of the photosensitive member 1**.

Figure 2:
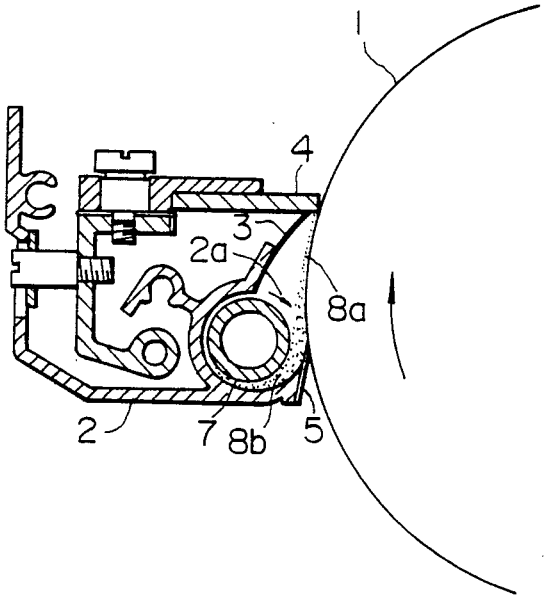
FIG. 2 PRIOR ART
FIG. 2 is a view similar to FIG. 1, but showing a conventional cleaning device.

In a conventional cleaning device shown in FIG. 2, part of a toner **8*b* that is collected in an opening portion 2*a* of a housing 2 and fails to be conveyed by a rotary screw 7 deposits on a seal member 5, and as the printing proceeds, the height of such deposited toner increases. As a result, the deposited toner is always held in contact with the surface of a photosensitive member 1, and part of the deposited toner is transferred or moved to a blade 4 by the rotation of the photosensitive member 1. This adversely affects the cleaning effect of the blade 4, and the distal end of the seal member 5 is spaced apart from the surface of the photosensitive member 1** due to the weight of the deposited toner, so that the interior of the machine is contaminated by the toner. Particularly, when the cleaning device is attached to and detached from the machine, the toner is scattered into the machine.

Figure 3:
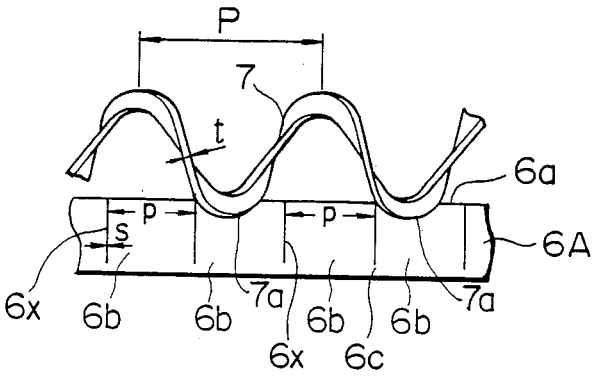
FIG. 3 is a fragmentary view showing a vibrating member and a convey means of the cleaning device of FIG. 1.
Figure 4:
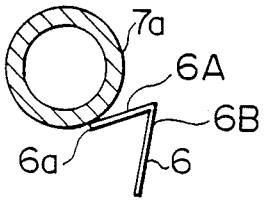
FIGS. 4 and 5 are cross-sectional views showing the operation of the vibrating member.
Figure 5:
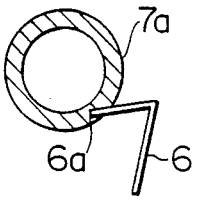

On the other hand, in the cleaning device according to the present invention, the vibrating member 6 is provided adjacent to and inwardly of the seal member 5, as shown in FIG. 1. The vibrating member 6 interferes with the rotary screw 7 of the convey means and is vibrated by it. The rotary screw 7 is adapted to be rotated in one direction by a drive means (not shown). As shown in FIG. 3, the vibrating member 6 is made of a polyethylene terephthalate film member. The vibrating member 6 includes a plate-like portion 6A and a leg portion 6B extending downwardly therefrom. The plate-like portion 6A extends substantially horizontally, and is formed with a number of slits **6*x* spaced from one another by a distance smaller than the pitch P of the rotary screw 7. The slits 6*x* extend from the distal end 6*a* of the vibrating member 6. Thus, the plate-like portion 6A of the vibrating member 6 is divided into a number of areas or sections 6*b* separated from one another by the slits 6*x*. The distal end 6*a* of the vibrating member 6 or the plate-like portion 6A is disposed inwardly of the outer periphery 7*a* of the rotary screw 7, and the divided sections 6*b* interfere with the outer periphery 7*a* of the rotary screw 7 in response to the rotation of the screw 7, so that each divided section 6*b* is urged downward (FIG. 4) by the rotation of the rotary screw 7, and then is returned to the initial position (FIG. 5). Each divided section 6*b* is repeatedly subjected to this operation, and therefore vibration is always imparted to the vibrating member 6 during the rotation of the rotary screw 7. The seal member 5 is separate from the vibrating member 6, and is fixedly secured to the opening portion 2*a* of the housing 2. Therefore, the seal member 5 is not vibrated in response to the vibration of the vibrating member 6, and hence is always held in contact with the surface of the photosensitive member 1**.

In the cleaning device of the illustrated embodiment, the toner, which would deposit on the opening portion **2*a* of the housing 2 in the conventional cleaning device to adversely effect the cleaning effect of the blade 4 and to cause contamination of the interior of the machine, can be easily destroyed by a simple construction in which the vibrating member 6 interfering with the rotary screw 7 to be vibrated is provided inwardly of the seal member 5. With this arrangement, the proper cleaning effect of the blade 4** is maintained, and the toner is readily prevented positively from leaking into and contaminating the interior of the machine, and the toner is readily prevented positively from scattering into the machine when attaching and detaching the cleaning device relative to the machine.

Further, since the vibrating member 6 is separate from the seal member 5, the seal member 5 is always held positively in contact with the surface of the photosensitive member 1, thereby preventing the leakage of the toner more positively.

In order to vibrate the horizontal plate-like portion 6A of the vibrating member 6 effectively of substantially entirely, each of the slits **6*x* has such a length as to reach or extend deeply into a toner receiving area of the vibrating member 6, i.e., an area of the plate-like portion 6A on which the toner scraped off and falling from the photosensitive member 1 is deposited. In other words, the slits 6*x* extend from the distal end 6*a* of the vibrating member 6 to the vicinity of the leg portion 6B which is fixed to the housing 2 at a location inside the seal member 5, and hence the divided sections 6*b* constitute large part of the toner receiving area of the vibrating member 6**.

In order to increase frequency of the vibration, it is preferable that the width s of each of the slits **6*x* is made to be near zero, or the width s is made smaller than the thickness t at a distal end of the rotary screw 7**.

In FIG. 3, character p indicates a pitch of the slits **6*x*, or the distance between the adjacent two slits 6*x* as measured along the distal end 6*a* of the vibrating member 6. It is preferable that the width s of each of the slits 6*x* is made smaller than the pitch p of the slits 6*x***.

In the case where the width s of each of the slits **6*x* is made larger and the length of each slit is made smaller, the vibration of the divided sections 6*b* caused by the rotary screw 7 is not preferably propagated to the deep part 6*c* of the vibrating member where the slits are not formed and hence the plate-like portion 6A** is not divided into a number of sections.

As described above, in the present invention, by providing the vibrating member, which interferes with the rotary screw to be vibrated, inwardly of the seal member, the deposition of the toner on the seal member is prevented. Therefore, the lowering of the cleaning effect of the blade as well as the scattering of the collected toner into the machine can be readily positively prevented.

Further, since the slits formed in the plate-like portion of the vibrating member extend deeply into the toner receiving area of the vibrating member on which the scraped-off toner is deposited and the large part of the above-mentioned toner receiving area is constituted from the divided sections, the area may be effectively vibrated by the rotary screw. Consequently, the toner received on the area may be positively led to the rotary screw.

What is claimed is:

1. A cleaning device for an electrophotographic copying machine having a photosensitive member comprising:

a housing;

a blade mounted on said housing for scraping off a residual toner from a surface of the photosensitive member;

a seal member mounted on said housing for guiding the scraped-off toner into said housing to collect the toner therein;

convey means having a rotary screw for conveying the collected toner from said housing to the outside; and a vibrating member mounted on said housing at a location adjacent to and inwardly of said seal member and interfering with said rotary screw to be vibrated;

said vibrating member including a plate-like portion, said plate-like portion having an edge portion contacted with said rotary screw and formed with a number of slits spaced apart from each other by a distance smaller than a pitch of said rotary screw.

2. A cleaning device according to claim 1, wherein said slits have such a length as to reach an area of said vibrating member on which the toner scraped off and falling from said photosensitive member is deposited.

3. A cleaning device according to claim 1, wherein each of said slits has a width smaller than a distance, at a distal end of said vibrating member, between the adjacent two slits.

4. A cleaning device according to claim 2, wherein each of said slits has a width smaller than a distance, at a distal end of said vibrating member, between the adjacent two slits.

5. A cleaning device according to claim 1, wherein said slits have a width smaller than a thickness at a distal end of said rotary screw.

6. A cleaning device according to claim 2, wherein said slits have a width smaller than a thickness at a distal end of said rotary screw.

7. A cleaning device for an electrophotographic copying machine having a photosensitive member comprising:

a housing;

a blade mounted on said housing for scraping off a residual toner from a surface of the photosensitive member;

a seal member mounted on said housing for guiding the scraped-off toner into said housing to collect the toner therein;

convey means having a rotary screw for conveying the collected toner from said housing to the outside; and a vibrating member mounted on said housing at a location adjacent to and inwardly of said seal member and interfering with said rotary screw to be vibrated;

said vibrating member having a substantially horizontal, plate-like portion and a leg portion extending downwardly therefrom, said leg portion being fixed to said housing at a location inside of said seal member, said plate-like portion having an edge portion contacted with said rotary screw and formed with a number of slits spaced apart from each other by a distance smaller than a pitch of said rotary screw and extending to the vicinity of said leg portion.

* * * * *